United States Patent [19]

Kotchy

[11] Patent Number: 4,508,249

[45] Date of Patent: Apr. 2, 1985

[54] FLASHLIGHT HOLDER

[76] Inventor: Alan W. Kotchy, 628 Garrison Ave., Nekoosa, Wis. 54457

[21] Appl. No.: 429,015

[22] Filed: Sep. 30, 1982

[51] Int. Cl.[3] ..... A45F 5/00

[52] U.S. Cl. ..... 224/219; 224/222; 224/267

[58] Field of Search ..... 224/219, 222, 267; 220/85 H, 94 R; D10/114; D26/39; 340/321, 81, 84, 87; 362/156, 190, 197, 200, 202, 205, 103, 108

[56] References Cited

U.S. PATENT DOCUMENTS

| | | | |
|---|---|---|---|
| D. 257,240 | 10/1980 | Leary | D26/39 X |
| 1,320,934 | 11/1919 | Schopp | 224/222 |
| 2,024,281 | 12/1935 | Gaskin | 224/219 |

*Primary Examiner*—John W. Shepperd

*Assistant Examiner*—David Voorhees

*Attorney, Agent, or Firm*—Andrus, Sceales, Starke & Sawall

[57] ABSTRACT

A flashlight holder includes a single strap having two sets of spaced openings which are provided at opposite ends of the strap. The strap can be separated into a pair of similar straps. The strap is formed of a resilient rubber-like material. The openings are defined by elongated slots or circular openings in the strap. The first opening of each set is constructed and arranged for connection to a spaced portion of the flashlight. The second opening of each set is adapted to be placed over the person's forearm including the wrist portion to project the light directly along the arm and the corresponding hand to light a working area. The openings are of a size and construction adapted to resiliently grip the flashlight and arm such that various angular orientations of the flashlight on the forearm may be provided.

11 Claims, 9 Drawing Figures

FLASHLIGHT HOLDER

BACKGROUND OF THE PRESENT INVENTION

This application relates to a flashlight holder and particularly to a holder for attaching a conventional tubular flashlight to the forearm of a person.

Persons working, inspecting or otherwise active in darkened and particularly small darkened areas, will often employ a conventional tubular flashlight for illuminating of the area. A conventional flashlight consists of a tubular housing with a light fixture secured to one end. The light fixture is conventionally removable to expose the end of the housing to receive a plurality of dry cell batteries. Conventionally the larger flashlights used by working personnel or the like use a plurality of C-type or D-type dry cell batteries. The D-type batteries are slightly longer and larger in diameter and have greater power capacity. If the person requires the use of both hands, the flashlight must be propped in position to illuminate the appropriate area or held by another person. Such other person may not be available, or it may not be convenient or possible to support the flashlight for the desired or necessary illumination. Further, in a working relationship the use of additional personnel unduly increases the cost. Thus, it is desirable to provide some means whereby the one person can appropriately locate the lamp or flashlight while using both hands. Special fixtures have been suggested for releasable securing to the workmen and particularly to the person's arm to permit projection of the light. The flashlight may be specially mounted in a special fixture to which the flashlight is attached. Various strap members are then secured through the fixture as a means for interconnecting of the fixture to the person's arm. For example, U.S. Pat. No. 1,200,403 which issued Oct. 3, 1916 to one Weyer discloses a special flashlight mounting fixture having strap means for interconnecting of the fixture to the person's arm. Other similar suggestions are shown in U.S. Pat. No. 1,923,962 which issued Aug. 22, 1933 and U.S. Pat. No. 2,024,281 which issued Dec. 17, 1935. A wire formated support for releasably clamping of a flashlight to the arm of a person is shown in U.S. Pat. No. 1,583,596 which issued May 4, 1926.

Although various suggestions have been made, none of them have been commercially exploited and are not at least commercially available to the present inventor's knowledge. Generally, it is believed that such devices are relatively complex, expensive and do not appear to be such as to be conveniently stored or carried. All of these factors tend to detract from the commercial practicality of the prior art suggestions and are in the opinion of the present inventor such as to prevent the feasable implementation of such structures on a large or mass scale. There is therefore a significant need for a relatively inexpensive and reliable flashlight holder device which permits the interconnection of the flashlight to the arm of a person. Such device should preferably permit the attachment such that the light can be projected longitudinally of the person's arm or otherwise located at some angular orientation for optimum positioning of the light and the illuminating pattern.

SUMMARY OF THE PRESENT INVENTION

The present invention is particularly directed to a flashlight holder for releasable mounting of a tubular flashlight to the limb and particularly the forearm of a person. Generally in accordance with the teaching of the present invention, the flashlight holder device comprises strap or band means defining two sets of longitudinally spaced clamping and mounting openings. The sets of spaced openings of the strap means are located for attachment to the opposite end portions of the flashlight and to spaced portions of the forearm. Thus, each set of openings includes a first opening adjacent the end of the strap and a second opening spaced immediately inwardly of the first strap opening. The four openings are thus arranged and constructed such that an opening of each set is interconnected to one of spaced portions of the tubular flashlight while the other openings are selectively adapted to be resiliently placed over the limb of the person to properly support the flashlight attached to the person's limb for illuminating selected areas.

In accordance with one preferred construction and embodiment of the present invention, a single strap or a pair of similar straps includes the two sets of openings. The first opening of each set is constructed and arranged for connection to a spaced portion of the flashlight. The second opening of each set is adapted to be placed over the person's forearm including the wrist portion to project the light directly along the arm and the one corresponding hand. This would generally provide optimum location of the light permitting common use of both hands while working in the illuminated area.

By constructing all openings including the inner openings of a size and construction adapted to resiliently grip the flashlight, various other angular orientations of the flashlight on the person's limb and particularly his forearm may be readily provided.

In one particularly practical flashlight holding device, the strap member is a single piece, flexible strap of a resilient rubber-like material. The openings are defined by elongated slots or openings in the strap. The end openings of the first and second sets are similarly formed as the flashlight gripping openings. The second openings of the first and second set are aligned with and spaced inwardly of the first openings and extend generally longitudinally of the strap. The second openings are slightly longer than the first. The longer openings conveniently stretch over the forearm and provide a comfortable but reliable interconnection of the flashlight holder device to the person for appropriate location of the flashlight. The openings can be of a substantially shorter length than the diameter of the flashlight and the person's limb by selecting a strap material with proper resiliency and stretching characteristic.

In another preferred embodiment, the strap means includes two identical straps formed of resilient material and having a pair of longitudinally spaced circular opening of different diameters. The smaller diameter opening fits on the flashlight and the larger on the person's arm.

These and similar constructural arrangements are more fully explained in connection with the illustrated embodiments of the invention as shown and described hereinafter. Such constructional arrangements, as well as the additional advantages and features of the present invention, are fully described in connection with the illustrated embodiment of the invention.

The present invention thus provides a reliable flashlight holder device which can be readily mass produced at a minimal cost. The flashlight holder device of the present invention is conveniently used and even more conveniently stored. The device should therefore find ready acceptance by the workmen in the field.

DESCRIPTION OF THE DRAWING FIGURES

The drawings furnished herewith illustrate a preferred construction of the present invention in which the above advantages and features are clearly disclosed as well as others which will readily be understood from the following description.

Figure 1:
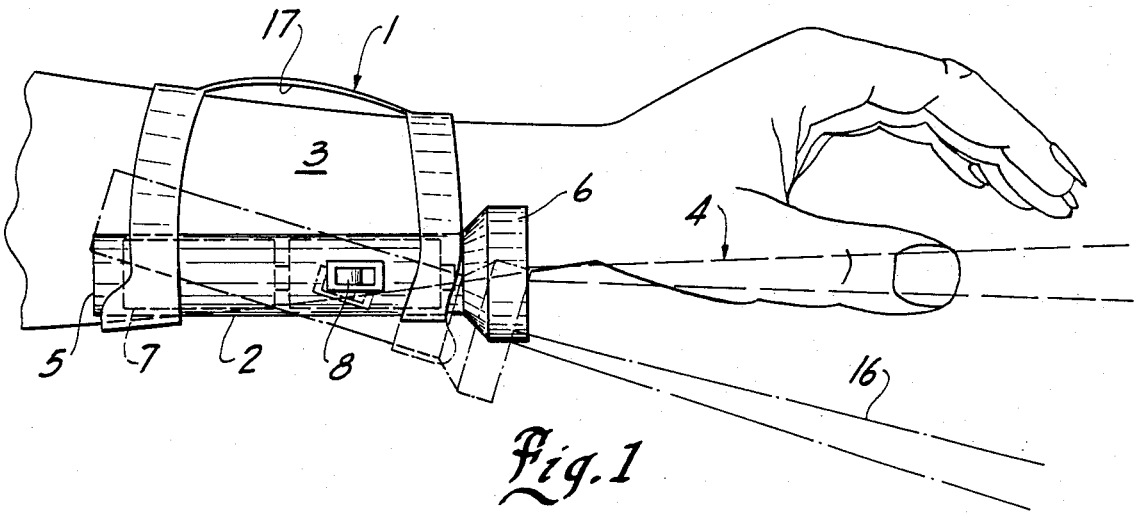
FIG. 1 is a pictorial view of a flashlight in a flashlight holder constructed in accordance with one embodiment of the present invention, and holding the flashlight to a forearm.
Figure 2:
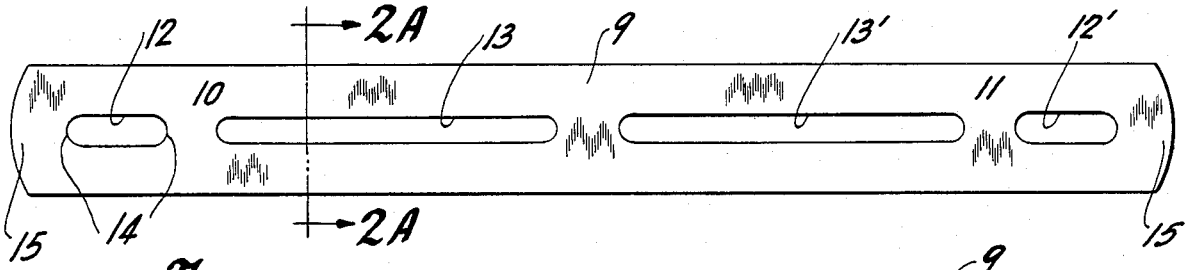
FIG. 2 is a plan view of the flashlight holder device shown in FIG. 1 separate from the flashlight.
Figure 2A:
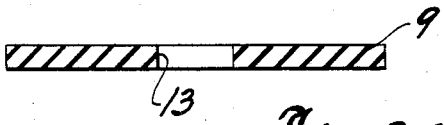
Figure 3:
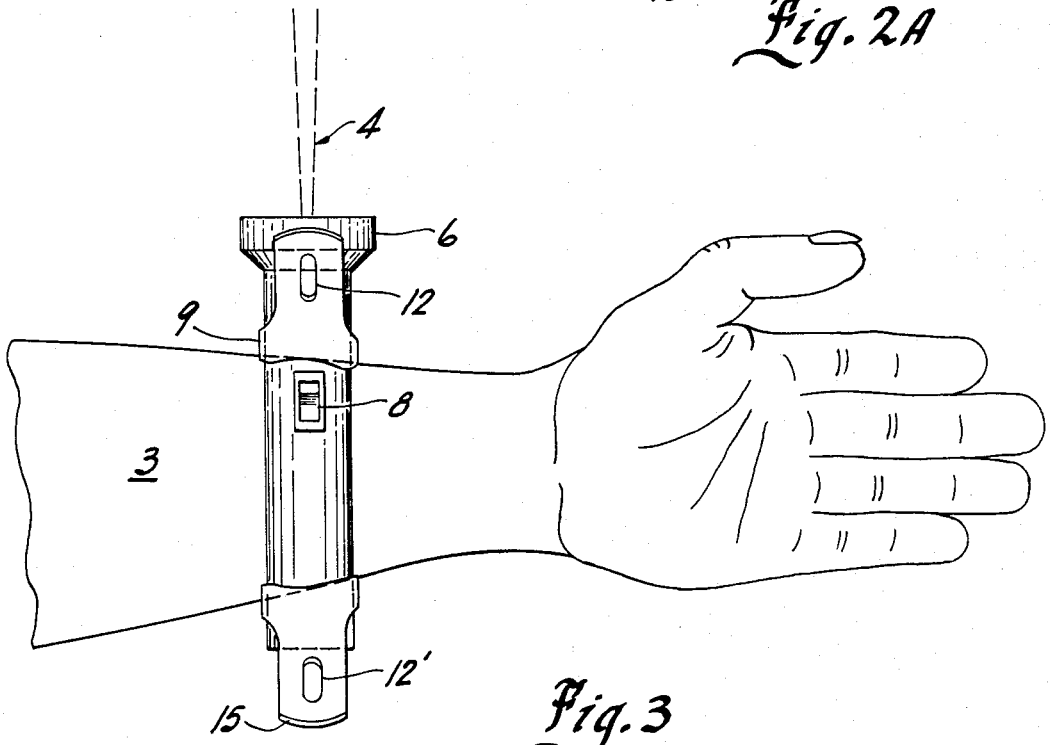
Figure 4:
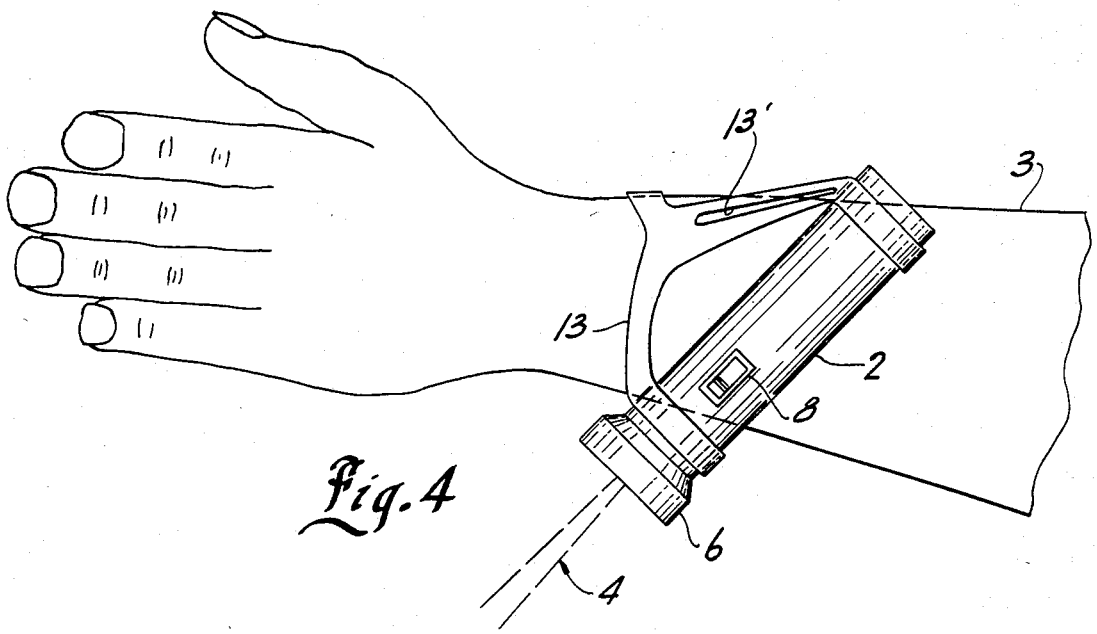
Figure 5:
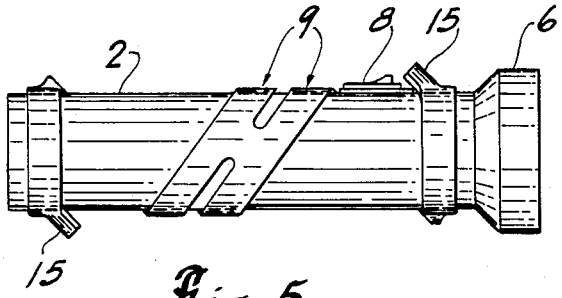
Figure 6:
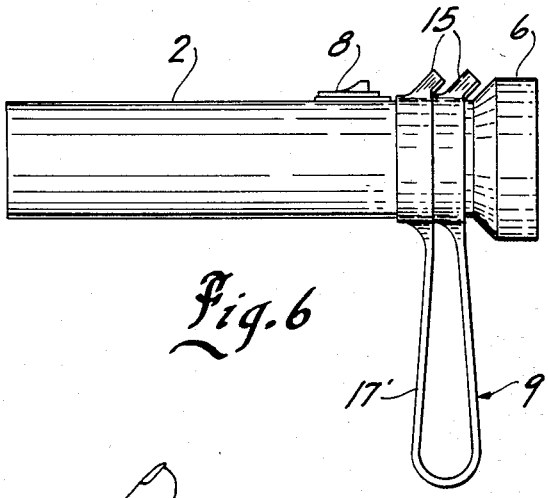
Figure 7:
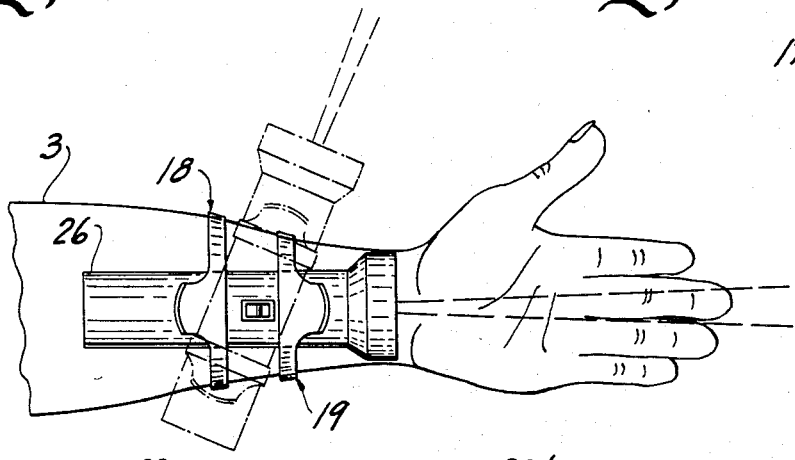
Figure 8:
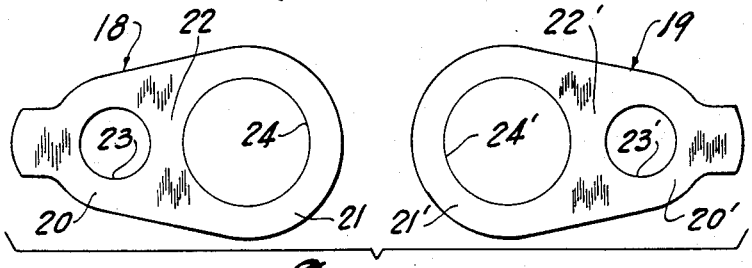

FIG. 2*a* is a vertical section taken generally on line 2*a*—2*a* of FIG. 2;

FIGS. 3 is a view illustrating the holder of FIGS. 1–2 supporting the flashlight extending perpendicularly to the person's forearm;

FIG. 4 is a view illustrating the flashlight held at an angle of 45 degrees to the forearm;

FIG. 5 is a view of the holder on a flashlight for storage;

FIG. 6 is another view of the holder differently located on a flashlight for storage;

FIG. 7 is a view similar to FIG. 1 illustrating an alternate embodiment of the flashlight holder; and FIG. 8 is a view of the strap shown in FIG. 7 separated from the flashlight.

DESCRIPTION OF THE ILLUSTRATED EMBODIMENT

Referring to the drawings and particularly to FIG. 1, a flashlight holder 1 illustrating a one embodiment of the present invention is shown. The holder 1 has its opposite ends secured to spaced portions of a conventional D-type or C-type dry cell flashlight 2 and to the spaced portions of the forearm 3 of a person, not otherwise shown. In FIG. 1, the flashlight 2 is located parallel to the forearm 3 and creates a light beam 4 directed longitudinally of the forearm and over the hand portion to illuminate a work or activity area aligned with the arm.

The flashlight 2 is illustrated as a conventional flashlight having a tubular housing 5 with a lamp unit 6 releasably secured to the outer end of the housing 5. The light unit 6 is as such of course removable to expose the one end of the housing 5 for insertion of batteries 7. A switch unit 8 is provided on the side of housing 5 to selectively turn the flashlight on and off in accordance with well known constructions. The flashlight 2 is thus shown as a typical well known construction and is described and shown only as required to explain the invention, which may of course be readily applied to other similar larger and smaller units.

Thus, the present invention is particularly directed to the construction of the flashlight holder 1, one structure of which is more clearly shown in FIGS. 2–4.

Referring particularly to FIG. 2, the flashlight holder 1 is an elongated strap or band 9, the opposite ends of which are constructed as specially securement portions 10 and 11 for interconnecting thereof to the flashlight 2 and to the forearm 3. Each end portion 10 and 11 is similarly constructed. The band 9 is shown as an integrally elongated band member, formed of a suitable rubber-like material such as a synthetic rubber. It is preferably a relatively soft rubber material having a high degree of stretchability and resiliency to permit stretching for interconnection to the flashlight 2 and the forearm 3, as presently described. Referring to end portion 10, the strap includes a first set of securement openings 12 and 13 and the opposite end portion is similarly constructed with a second set of securement openings 12′ and 13′. The outermost openings 12 and 12′ are relatively short but are constructed to slip over the end of the flashlight housing 5. The resiliency of the strap 9 is such as to provide a firm grasping of the flashlight.

The second openings 13 and 13′ are spaced inwardly from the first openings 12 and 12′ and are substantially longer than the first openings. The second opening 13 and 13′ are adapted to be stretched and fitted over the upper forearm and wrist of the forearm 3, as shown in FIG. 1.

As most clearly shown in FIG. 2, the opening 13 may be slightly smaller than the opening 13′ to permit a more convenient and reliable interconnection to the smaller wrist portion of the forearm 3.

A preferred construction of the slotted band is particularly as shown in FIGS. 2 and 3. Each of the openings 12 and 13 inclusive is formed as a distinct elongated slot extending longitudinally of the band 9. Referring particularly to the opening 12, the opening is shown as a distinct clearthrough opening having side edges spaced laterally from each other. The opposite ends of the side edges are similarly connected by similar curved or round ends 14. This provides a distinct but stable opening in the band 9. As illustrated most clearly in FIGS. 2 and 3, the outer ends of the strap or band 9 are preferably extended outwardly as tabs 15. This permits the convenient gripping of the ends of the straps and positioning of the strap or band onto the flashlight 2 as well as to angularly orient the strap member about the arm 3.

Thus each of the openings 12–13 serves to frictionally grasp and thereby circumferentially and longitudinally locate the strap on the flashlight 2 and on the forearm 3. The strap 9 thereby determines and sets the location and orientation of the flashlight 2 with respect to the forearm 3.

The flashlight holder 1 is illustrated in FIG. 1 with the flashlight slots 12 and 13 similarly circumferentially oriented on opposite end portions of the housing 5. With the forearm extending through the limb openings 13 and 13′ and the side of the forearm 3 located adjacent to the flashlight 2, the flashlight 2 is held above the forearm 3 with the lamp unit 6 located adajacent to the wrist portion of the arm 3 to project the light beam 4 outwardly over the hand. The flashlight 2 can of course be appropriately located in parallel relationship to the forearm or in any desired location about the forearm by merely properly locating of the forearm through the limb openings 13. If a precise parallel relationship is not desired, offsetting of the light beam 4 can be readily accomplished by relative rotation of the resilient strap 9 on the forearm. Thus, if the upper or outermost forearm portion is rotated, the corresponding outer end of the flashlight is correspondingly offset with respect to the opposite end of the flashlight 2. This twist the flashlight 2 on the arm 3 as shown in phantom in FIG. 1, and directs the flashlight 2 and light beam 4 to an angle as at the forearm. This movement is of course readily provided as a result of the resiliency and flexibility of the band.

Although the illustrated mounting of the flashlight to the forearm constitutes the position which may be most widely used, whenever necessary or desirable, the flashlight can be turned to otherwise angularly orient the light beam with respect to the forearm or other limb to which it is attached. For example, one may wish to locate the light beam 4 extending perpendicular or essentially perpendicular to the forearm 3. Such positioning can be readily created by placing the flashlight through the arm openings 13 and 13', as shown in FIG. 5.

The forearm 3 is extended through the connecting portion between opening 13 and 13' which defines a loop 17 between the strap 9 and the flashlight 2, which is then in position extending essentially perpendicular to the forearm. The forearm 3 in passing through the loop expands or stretches the band 9 and improves resilient clamping of the flashlight to the forearm. The projecting of light in the opposite direction is accomplished by merely passing the forearm through the loop in the opposite direction. If the loop 17 is too small, it can be readily enlarged by placing of the flashlight through either one or both of the normal openings 12 and/or 12'.

The rearrangement of the openings 12–13 may also provide ready mounting of the flashlight to provide projection of light beam 4 and 45 degrees to the forearm 3. For example, referring to FIG. 4, the flashlight 2 is shown secured to the forearm 3 in such a manner as to establish a light beam 4 extending downwardly at 45 degrees to the length of the forearm. This orientation is readily provided for example, by the attachment of the openings 12 and 12' to the corresponding opposite ends of the housing, as shown in FIG. 4. The forearm 3 is extended through the front limb opening 13 adjacent light unit 6. The opposite ends of the strap 9 including the limb opening 13' is extended over the top of the forearm 3. The band is angularly oriented about the arm to locate the center portion to the top back side or other side of the forearm.

The opposite angular orientation is similarly readily provided, for example, by passing the forearm 3 through the limb opening 13' adjacent the rear or outer end of the flashlight 2.

Although such angular orientation may not be often required, the present invention with the multiple openings provide a convenient and ready means of properly mounting a flashlight for such orientation and illumination.

Further, with the resilient strap type connections the strap can be conveniently stored on the flashlight. Thus if one end of portion of the strap is rotated on the flashlight from the position shown in FIG. 5, it will of course result in a spiral winding of the strap 9 onto the flashlight to permit convenient, compact storage thereof. The band 9 may also be readily positioned to permit insertion of the flashlight into the holder. For example, the rear or outer band end may be readily moved into immediately adjacent relationship to the forward end, as shown in FIG. 6, thereby locating a loop 17' adjacent the light unit 6 and freeing the housing for insertion into a flashlight holder, or placing the loop 17' onto a belt or the like for support. Thus the integrated single piece band with the four spaced openings within the integral band provides a useful and practical implementation of the present invention.

The openings can of course be formed in any suitable manner. The illustrated distinct clearthrough openings provide a practical implementation of the present invention. Other forms have been employed. For example, a similar band holder may be formed with a single slit for each opening 12–13 in the band of an appropriate length for corresponding resilient gripping of a flashlight. The ends of each slit is preferably provided with enlarged end openings to prevent tearing of the band along the slit as the result of the stretching of the band and in placement onto the flashlight and limb.

Although illustrated in one preferred embodiment including a single integral rubber-like member, the invention can of course be otherwise constructed. For example, the central portion of the band may be formed of a suitable resilient material or with suitable portions of resilient material and interconnected by nonresilient material, and with suitable resilient material to permit the clamping of the flashlight and the person's limb. Further although shown with the aligned elongated openings, appropriately offset or even overlapped openings may be used. Further, the band may be formed with other than a slot or slit type opening. For example, the band could be formed with appropriate circular portions having appropriate circular openings defining the several oenings for attachment to a flashlight and to a limb.

These and many other variations can of course be readily applied. The openings may even be formed by dividing the band to form opening forming members having suitable interconnecting means for adjusting the size of the opening but such construction may increase the construction cost and thereby reduce the cost efficiency of the invention as well as the simplicity of use.

A two-piece holder is shown for example in FIGS. 5 and 6. Thus, the holder includes first and second band or strap 18 and 19, each of which is shown identically constructed. As shown most clearly in FIG. 6, the element 18 is shown consisting of two portions 20 and 21, which may be circular or other shaped portions connected by connecting neck or bridge 22. The circular portion has an opening 23 and the portion 21 has an opening 24. The strap 18 also is shown with a positioning tab 25. Strap 19 is similarly formed with portion 20' and 21' having opening 23' and 24'. Thus, by applying strap 18 through opening 23 to the forward or light end of a flashlight 26 and the second strap 19 to the outer or back end of the flashlight 26, the straps 18–19 permit the selective placement of the flashlight to the forearm of a person. In FIG. 5, the forearm is shown placed through openings 24 and 24' and the flashlight 26 located parallel to the arm. By rotating of the straps 18 and 19 relative to each other the light direction again changes to any angular orientations.

The present invention thus provides a reliable and readily applied flashlight holder for interconnecting of the flashlight to the limb of a person for optimum illumination of an area while permitting the person to use both of his hands in such area. The structure can be readily mass produced employing well known technology and apparatus as well as materials thereby contributing to an effective low cost flashlight holder.

Various modes of carrying out the invention are contemplated as being within the scope of the following claims and particularly pointing out and claiming the subject matter which is regarded as the invention.

I claim:

1. A flashlight holder including first and second straps, each of said straps comprising a single piece strap of a resilient material having a thickness substantially less than the width of the strap, said strap having first and second openings located respectively in opposite longitudinal halves of said strap, a first of said openings defining an opening adapted to stretch over flashlight whereby said straps are connected to opposite end portions of the flashlight, said second of said openings being larger than said first openings and being adapted to stretch over a forearm, each of said straps including spaced enlargements connected by a connection portion, and said first openings have a length of approximately one inch, and said second openings have a length of approximately three inches.

2. A flashlight holder device for attaching a tubular flashlight of the C and D battery type to the limb of a person, comprising an elongated strap member having a length greater than the length of the flashlight, said strap having at least two sets of longitudinally spaced openings with one set adjacent one end of the strap and the second set adjacent the opposite end of said strap, each set of spaced openings including a first opening adjacent the end of said strap and second opening spaced immediately inwardly of said first opening, said first opening being constructed to resiliently fit over the flashlight to resiliently grasp the flashlight, said second opening being constructed to resiliently fit over the limb of the person to resiliently grasp the limb and thereby releasably affix the flashlight to the limb.

3. The flashlight holder device of claim 2 wherein said strap is a one-piece member formed of a soft, rubber-like material, and said openings being formed therein.

4. The flashlight holder device of claim 2 wherein said strap includes rubber-like portions formed of a resilient rubberlike material and including said first and second openings, said first opening is an elongated narrow opening in the rubber-like materials, and said second opening is an elongated narrow opening longitudinally aligned with the first opening.

5. The flashlight holder device of claim 2 wherein said first and second openings are slits in the rubber-like portions of said strap.

6. The flashlight holder device of claim 5 wherein said first and second openings have spaced longitudinal side edges to define clear first and second openings.

7. A flashlight holder device for supporting a flashlight having an elongated tubular housing having a series longitudinally aligned and abutting drycell batteries of the D-type or the C-type, comprising flexible strap having a width substantially the width of the flashlight and a length substantially the length of the flashlight, said strap being formed of a resilient rubber-like material, a first set of openings in one end of the strap and a second set of openings in the second end of the strap, each set of openings including a first elongated opening extending longitudinally of the strap and a second elongated opening spaced slightly from the first elongated opening and extending longitudinally of the strap, said first opening having a length slightly less than said flashlight diameter and adapted to be placed in resilient gripping engagement over an end portion of the flashlight whereby said strap is adapted to be affixed to the opposite ends of the flashlight, said strap having a length to establish a slack strap between the opposite attached portions, said second openings having a length greater than the width of a limb of a person and adapted to be placed in resilient gripping engagement over spaced portions of the limb of a person for locating the flashlight longitudinally aligned upon the limb.

8. The flashlight holder device of claim 7 particularly adapted for attachment to the forearm limb of a person and wherein said second opening of said first set is slightly longer than the second opening of said second set, whereby the said second openings are respectively adapted for attachment to the upper forearm portion and the wrist portion of a person.

9. The flashlight holder device of claim 8 wherein said openings are located substantially centrally of the strap and in common plane through said strap.

10. The flashlight holder device of claim 7 wherein strap includes outer end tabs for manual gripping of the strap end and positioning thereof on the flashlight.

11. The flashlight holder of claim 7 wherein the strap is a rectangular member of a resilient soft rubber-like material, said band having a length of approximately one foot, said band having said first openings as elongated slot of a length less than the diameter of the flashlight and located adjacent opposite end portion of the band, said band having said second openings as elongated slots longer than said first elongated slots, said first and second slots being adapted to be stretched opened and placed over the flashlight and limb to grasp longitudinally spaced portions of the flashlight, the forearm including the wrist of a person.

* * * * *

UNITED STATES PATENT AND TRADEMARK OFFICE

CERTIFICATE OF CORRECTION

PATENT NO. : 4,508,249

DATED : April 2, 1985

INVENTOR(S) : Alan W. Kotchy

It is certified that error appears in the above-identified patent and that said Letters Patent is hereby corrected as shown below:

Col. 3, line 19, Cancel "Figs. 3" and substitute therefor ---Fig. 3---; Col. 4, line 63, Cancel "twist" and substitute therefor ---twists---; Col. 5, line 26, Cancel "and" and substitute therefor ---at---; Col. 6, line 23, Cancel "oenings" and substitute therefor ---openings---; Claim 1, col. 7, line 3, After "over" insert ---a---; Claim 2, col. 7, line 20, After "and" insert ---a---; Claim 10, col. 8, line 32, After "wherein" insert ---said---

Signed and Sealed this

*Twenty-sixth* Day of *November 1985*

[SEAL]

*Attest:*

DONALD J. QUIGG

*Attesting Officer*

*Commissioner of Patents and Trademarks*